United States Patent [19]

Busso et al.

[11] Patent Number: 5,017,836

[45] Date of Patent: May 21, 1991

[54] ELECTRONIC FEEDER FOR AN ION PUMP

[75] Inventors: Mario Busso, Turin; Mauro Audi, Rivoli, both of Italy

[73] Assignee: Varian, S.p.A., Leint, Italy

[21] Appl. No.: 331,636

[22] Filed: Mar. 30, 1989

[30] Foreign Application Priority Data

Apr. 14, 1988 [IT] Italy ..... 67345 A/88

[51] Int. Cl.[5] ..... H01J 41/12

[52] U.S. Cl. ..... 315/111.91; 324/460; 417/49

[58] Field of Search ..... 315/111.91; 324/460; 417/49

[56] References Cited

U.S. PATENT DOCUMENTS 3,186,632 6/1965 Connor ..... 417/49
3,429,501 2/1969 Hamilton et al. ..... 417/49
4,713,619 12/1987 Busso et al. ..... 315/111.91 X

FOREIGN PATENT DOCUMENTS 987279 3/1965 United Kingdom .

*Primary Examiner*—Eugene R. LaRoche
*Assistant Examiner*—Do H. Yoo
*Attorney, Agent, or Firm*—Austin R. Miller

[57] ABSTRACT

An improved electronic device allows for the feeding of an ion pump with a plurality of voltages that are changed as a function of the current drawn by the pump and therefore of the pressure value within the pump.

7 Claims, 5 Drawing Sheets

ELECTRONIC FEEDER FOR AN ION PUMP

BACKGROUND OF THE INVENTION

This invention relates to an improved power supply or feeder for an ion pump.

On the basis of the technical knowledge about the ion pumps, the pumping speed or rate for a given pressure should be proportional to the ion current and therefore to the voltage applied across the electrodes; as a consequence, the pumping speed should increase with the voltage. While such phoenomenon has been verified in the pressure range from $10^{-7}$ to $10^{-5}$ mbar, at pressures lower than $10^{-7}$ mbar the pumping speed of an ion pump does not appear to show any longer a behaviour proportional to the voltage applied to its electrodes.

Thus the problem arises to determine the voltage values adapted to maximise the pump performances in the different pressure ranges at which it may be operated.

U.S. Pat. No. 3,429,501 to Hamilton et al. relates to an ion pump fed by a first voltage at low pressures—and therefore at low currents—which is higher than the voltage supplied to the pump at higher pressures, in order to keep constant at the optimum value the supplied power.

U.S. Pat. No. 4,713,619 of the same Applicant relates to a feeder for an ion pump wherein a suitable electronic circuit alternatively switches between two feeding voltages—a high one and a low one—independentely of the current. The two voltage cyclic feeding aims to reduce the influence of the field effect current on the overall current and to allow the use of the ion pump as a pressure measuring device even of very low pressures (below $10^{-6}$ mbar) thanks to an extension of the linear range of the current/pressure characteristic.

Nevertheless neither of the above mentioned patents provides for a solution to optimize the pump performances at low pressures, nor considers the influence of the feeding voltage on the pumping speed.

Therefore the present invention aims to eliminate or to reduce the inconveniences of the known feeding systems for ion pumps, by providing a feeder which is able to optimize the pump performances in every pressure range, particularly at the lower pressures (below $10^{-7}$ mbar) which further allows for the use of the pump as a pressure measuring device.

SUMMARY OF THE INVENTION

The above and additional objects and advantages of the invention, as will be evident from the following description, are obtained by means of an improved feeder for an ion pump comprising a transformer and means for rectifying and filtering the alternating current from said transformer, characterized in that said transformer is controlled by means for changing the feed voltage of the primary winding, such change being in the same direction as the change of the current drawn by the ion pump.

Some preferred, exemplary and non limiting embodiments of the invention will now be described with reference to the attached drawings.

DESCRIPTION OF PREFERRED EMBODIMENTS

The invention refers to an electronic device for feeding an ion pump which is adapted to supply a plurality of different feed voltages according to a function which is proportional to the current drawn by the pump.

Otherwise stated, the larger the drawn current, the higher has to be the feed voltage.

Figure 1:
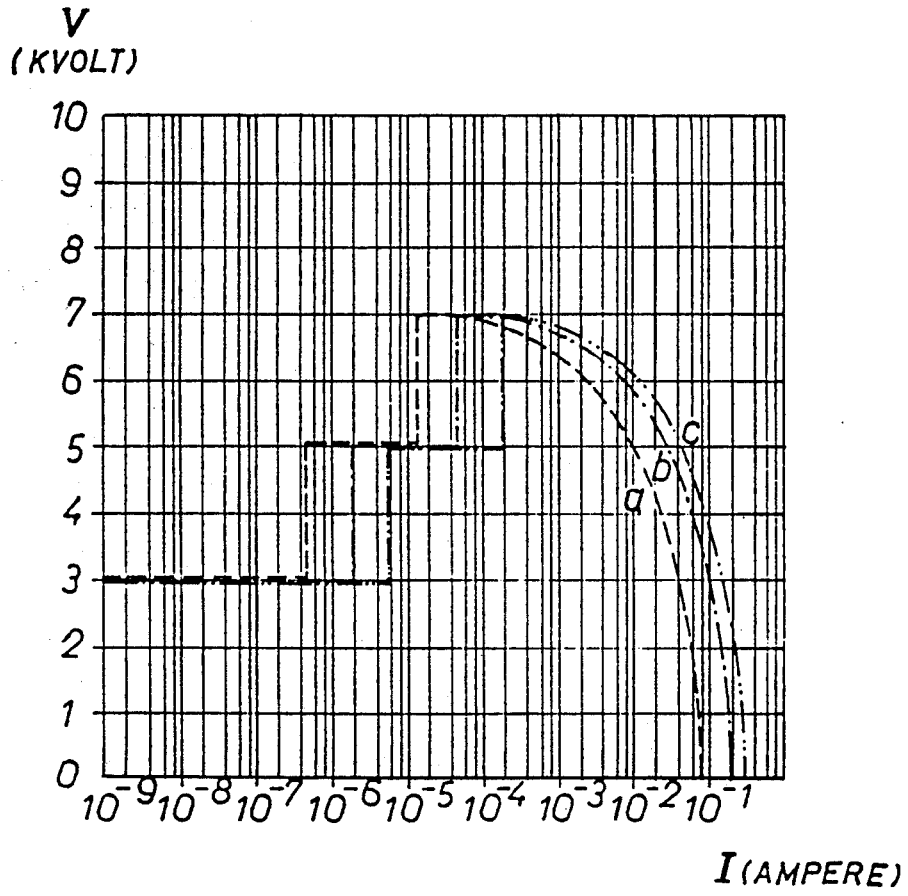
FIG. 1 is a diagram showing a typical voltage/current curve for an ion pump fed by the electronic devices disclosed by the present invention.

The situation is schematically shown in the diagram of FIG. 1 illustrating how the feed voltage varies as a function of the current drawn by the ion pump when this latter is provided with a feeder according to the invention. The curves a, b, and c illustrate the voltage change as a function of the current for ion pumps having a pumping speed of $5 \div 10$ l/s, $30 \div 60$ l/s and $120 \div 250$ l/s, respectively.

Bearing in mind the existing relationship of direct proportionality between the current drawn by the ion pump and the exiting pressure, and therefore the fact that to high pressures correspond large current drains and to low pressures correspond low current drains, the following embodiments according to the invention for feeding an ion pump are considered.

Figure 2:
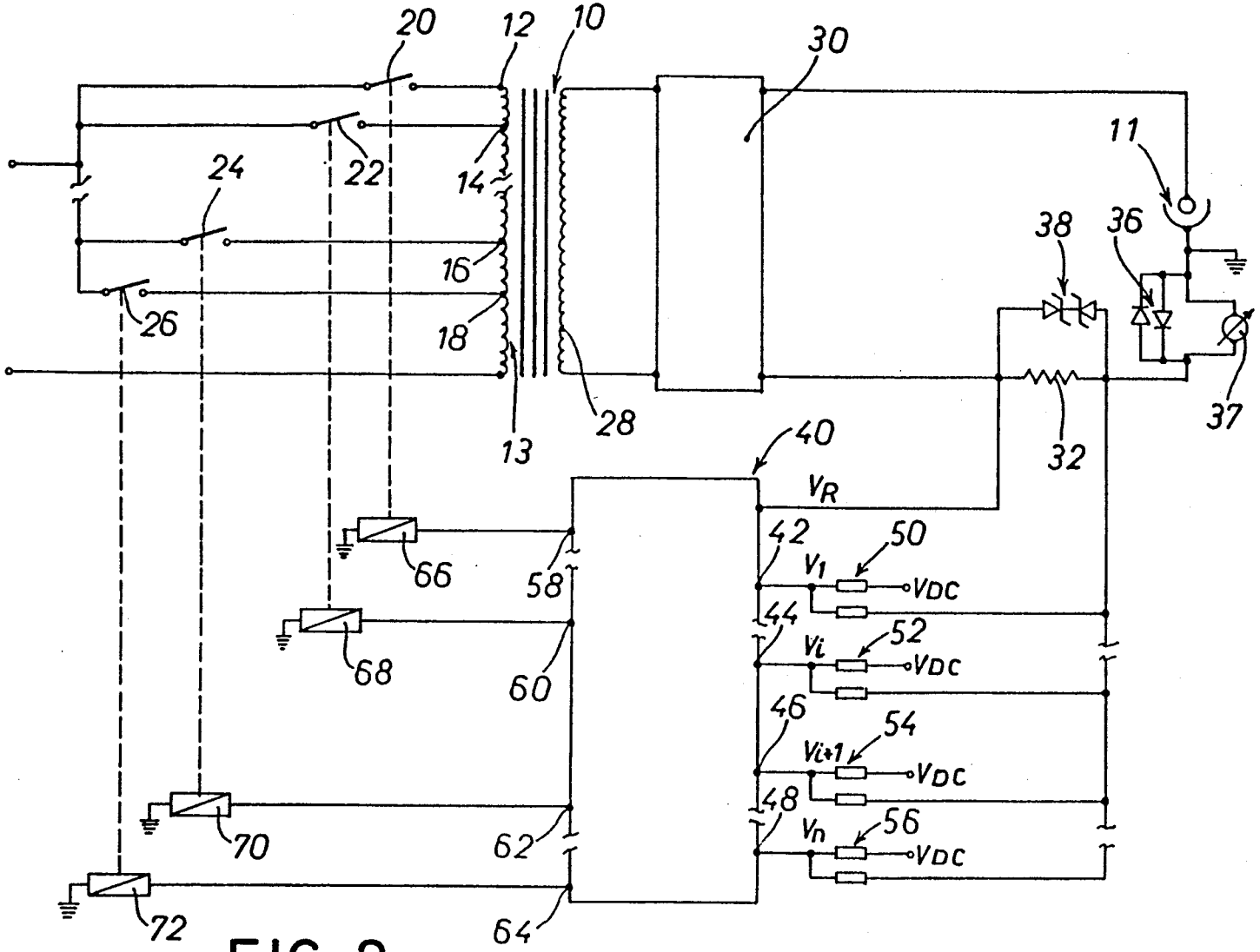
FIG. 2 schematically shows a first embodiment of the electronic device according to the invention.

FIG. 2 schematically shows a first embodiment of the electronic device for feeding an ion pump according to the invention.

The circuit comprises a step up voltage transformer 10 having a primary winding 13 providing for a plurality of taps 12, 14,. . . 16, 18 connected to as many contacts 20, 22,. . . 24, 26 adapted to connect the primary winding with the line voltage.

Such contacts 20, 22,. . . 24, 26 are alternatively switched over to produce a change of the voltage induced in he secondary winding 28 of the transformer 10 in order to obtain a plurality of voltages at the terminals of the ion pump 11.

The circuit also provides for a rectifier and filter assembly 30 adapted to convert the output a.c. voltage from the transformer secondary winding into a d.c. voltage for feeding the ion pump.

The current flowing in the ion pump 11 also passes through resistor 32 thus generating across its terminals a voltage which is directly proportional to the amount of current circulating in the ion pump.

The ion current is continuously measured by an electrometer 37 in parallel to a rectifier assembly 36.

Two stabilizing diodes, technically known as Zener diodes, connected together with opposed polarities, determine the maximum voltage allowed (e.g. 10 V) across the resistor 32.

The voltage across the resistor 32 is led to the inputs of a threshold discriminator (or detector) circuit 40.

Such circuit is adapted to alternatively enable or disenable its outputs as a function of the input voltage levels.

Therefore, across the resistor 32 there will be available a voltage signal $V_R$ (e.g. comprised within 0 and 10 V) which is proportional to the current circulating in the ion pump, and such voltage can be applied to one input of the threshold discriminator circuit 40.

At the inputs 42, . . . 44, 46, . . . 48 there will be present fixed voltage signals having values determined by the values chosen for the resistive voltage divider 50, . . . 52, 54, . . . 56, each having a different value.

At the outputs 58, . . . 60, 62, . . . 64 of the threshold discriminator circuit 40 there are connected the relay coils 66, . . . 68, 70, . . . 72, the contacts 20, 22,. . . 24, 26 of which feed the various taps in the primary winding of transformer 10, as above discussed.

The operation of the above circuit is the following.

When the voltage signal $V_R$ across resistor 32 is comprised between zero and a $V_1$ value (e.g. between 0 and 1 V), that is it corresponds to a minimum value of the current circulating in the ion pump due to the presence of a low pressure within it, the threshold discriminator circuit 40 only actuates relay 66 and consequentely contact 20 connected to the primary winding 12 of the transformer 10.

In this first situation, the voltage induced in the secondary winding of the transformer corresponds to the lower feed voltage for the ion pump (e.g. 3,000 V).

A pressure increase within the ion pump produces a proportional increase of the current drawn by the ion pump, hence a change of the voltage across the resistor 32, thereby causing a shift of the intervention threshold of the discriminator circuit 40.

When the voltage signal across the resistor 32 is comprised between a $V_i$ value and a $V_{i+1}$ (e.g. between 4 and 5 V), corresponding to a medium value of the current in the resistor 32 due to the presence of a medium pressure within the ion pump, the discriminator circuit 40 only actuates relay 68 and hence contact 22 connected to the primary winding 12 of the transformer 10, thus removing voltage from relay 66 and opening the contact 20.

In this second situation, the induced voltage on the transformer secondary winding corresponds to a medium feed voltage for the ion pump (e.g. 5,000 V).

A further increase in the pressure within the ion pump causes a proportional increase in the current drawn by the ion pump, and hence a change in the voltage across the resistor 32 and thus a shift of the intervention threshold of the discriminator circuit 40.

Finally, when the voltage signal across the resistor 32 reaches the maximum value $V_n$ determined by the Zener diodes 38 (e.g. equal to 10 V), the discriminator circuit 40 only actuates relay 72 and hence the contact 26, thus removing voltage from the preceding relay.

In this third situation the the induced voltage on the transformer secondary winding corresponds to the maximum feed voltage for the ion pump (e.g. 7,000 V).

Although only three situations for the discriminator intervention have been disclosed, there can be many more, according to the type and to the complexity of the employed discriminator circuit 40.

Figure 3:
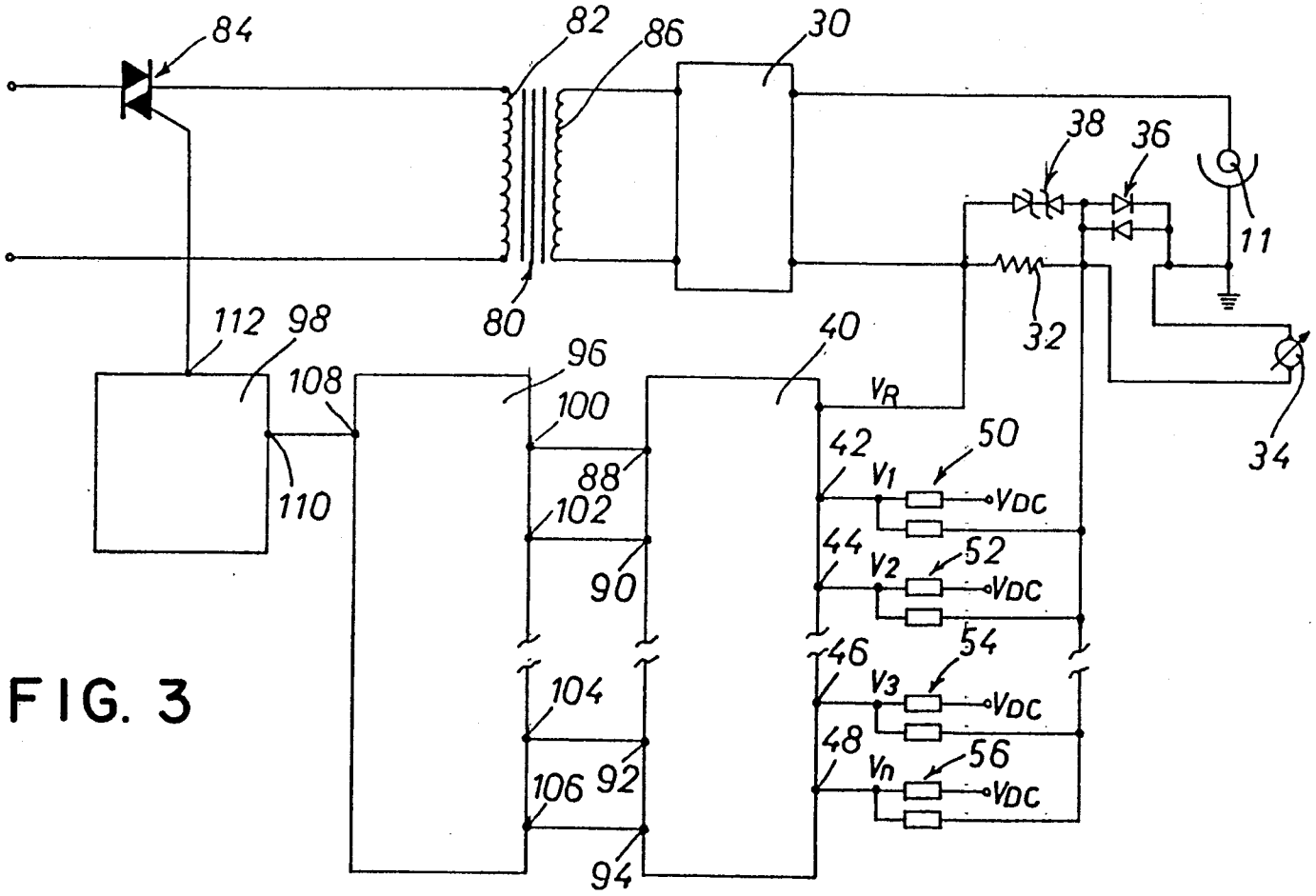
FIG. 3 schematically shows a second embodiment of the electronic device according to the invention.

In FIG. 3 a second embodiment of the electronic device for feeding an ion pump is illustrated.

The operating principle is similar to that of the already illustrated circuit, but instead of a plurality of relays 66, . . . 68, 70, . . . 72 feeding the transformer 10 through a plurality of taps, the transformer 80 only provides for a single primary winding 82 receiving a variable voltage which is controlled by a triac 84 in series with such primary winding.

Similarly to the preceding case, the current from the secondary winding 86, after being rectified and filtered by the assembly 30, feeds an ion pump through a resistor 32 in parallel with a Zener diode stabilizing assembly 38.

A variable voltage $V_R$ (e.g. from zero to 10 V) which is proportional to the current drawn by the ion pump, is collected across the above resistor 32.

Also in this second embodiment, the voltage $V_R$ is applied to the input of the discriminator circuit 40 and then compared with the fixed voltages at the other discriminator inputs 42, 44, . . . 46, 48, as already described for the first embodiment.

The outputs 88, 90, . . . 92, 94 are connected to a second conversion circuit adapted to supply an output d.c. voltage which is stepwise variable (e.g. between 3 and 7 V).

The output voltage of this conversion circuit 96 is led to a further trigger circuit 98 which renders the triac 84 conductive.

The circuit operation in this second embodiment is the following.

When the voltage signal across the resistor 32 is comprised between zero and $V_1$ (e.g. between 0 and 1 V), the discriminator circuit 40 only actuates the output 88 which in turn is connected to the input 100 of the conversion circuit 96.

The output 108 of the conversion circuit 96 goes to a voltage value corresponding to the first step level (e.g. 3 V); such voltage is then transferred to the input 110 of the trigger circuit 98.

The output 112 of the trigger circuit 98 is connected to the gate of the triac 84, driving this latter in conduction for a small fraction of the sinusoidal wave of the feeding a.c. voltage.

Figure 4A:
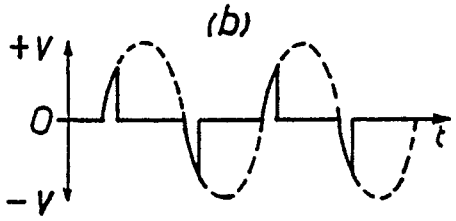
FIG. 4 shows some examples of the waveforms which are generated and controlled by the circuit shown in FIG. 3.
Figure 4B:
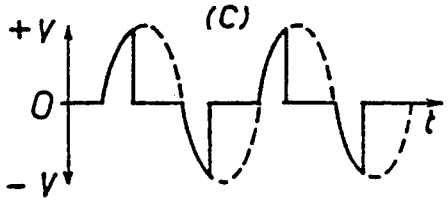
Figure 4C:
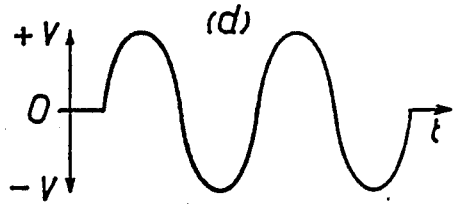

A voltage waveform such as the one shown at "b" in the diagram of FIG. 4 will be present at the primary winding.

Under these conditions, the ion pump feed voltage is the minimum foreseen (e.g. 3,000 V).

An increase in the current of the ion pump 11 also causes an increase of the voltage across the resistor 32.

When such voltage $V_R$ is comprised between $V_1$ and $V_2$ (e.g. between 1 and 2 V), the discriminator circuit enables only the output 90 connected to the input 102 of the conversion circuit.

The output voltage of this latter circuit rises to a higher value thus reaching the second step level (e.g. 3.5 V), and is led to the input of the trigger circuit 98.

The voltage at output 112 of such circuit is led to the triac which will be conducting for a time interval longer than the previous one, thus supplying to the primary winding 82 of the transformer 80 a waveform such as the one illustrated in FIG. 4 under "c".

The ion pump feed voltage is thus higher than the previous one (e.g. 4,000 V).

Finally, when the voltage signal across the resistor 32 reaches the maximum value $V_n$ set by the Zener diodes (e.g. 10 V), the discriminator circuit 40 enables only the output 94 connected to the input 106 of the conversion circuit.

The output 108 of such circuit rises to the maximum value of the stepwise voltage (e.g. 7 V), and such potential is applied to the input 110 of the trigger circuit 98 of the triac.

Under these circumstances, the triac will be conducting during the whole phase angle and a full waveform, as shown in FIG. 4 at "d", will be present at the primary winding 82 of the transformer 80.

The feed voltage to the ion pump will be the maximum one (e.g. 7,000 V).

Figure 5:
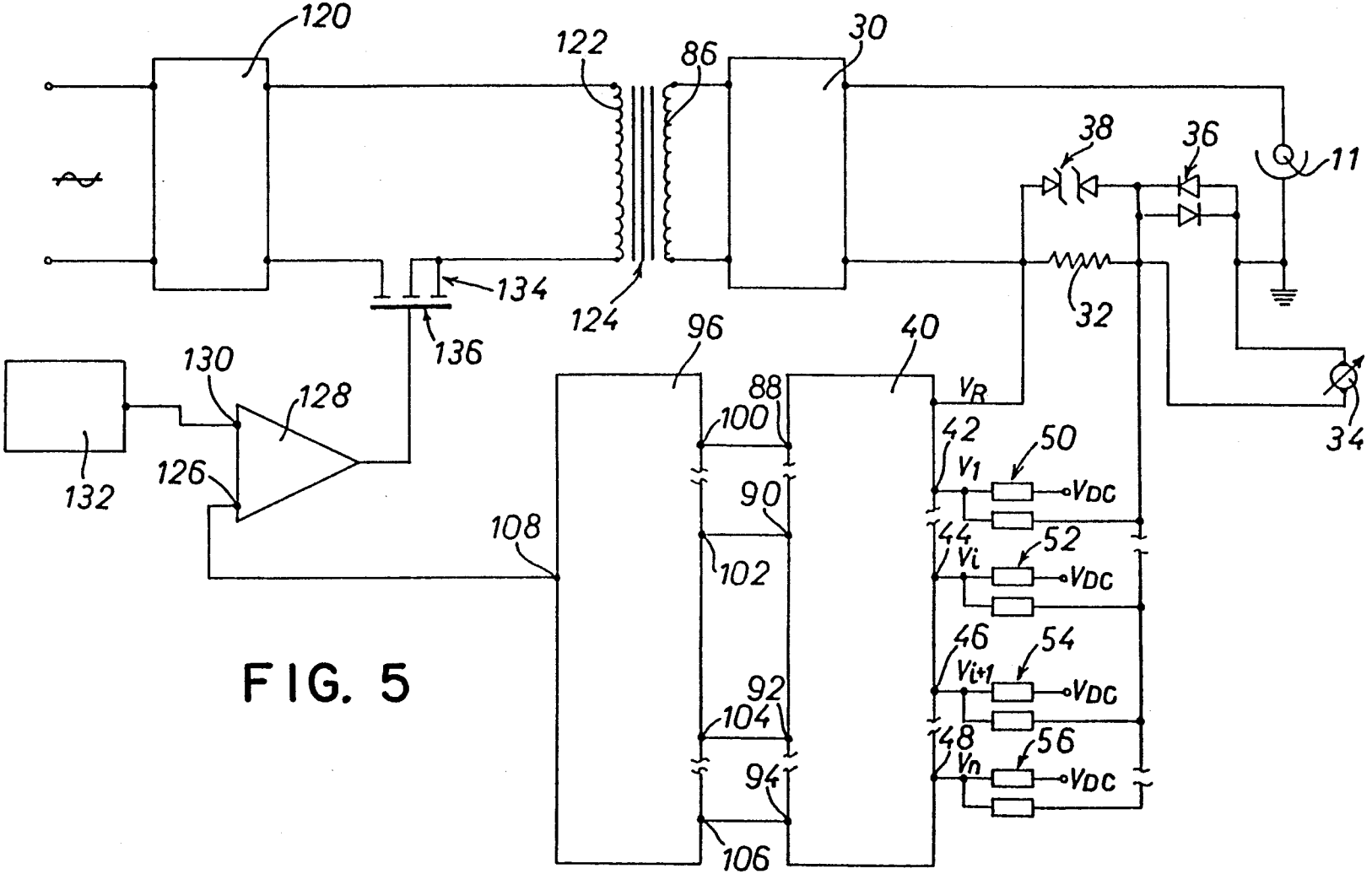
FIG. 5 schematically shows a third embodiment of the electronic device according to the invention.

In FIG. 5 there is schematically represented a third embodiment of the electronic device for feeding an ion pump.

This third embodiment is based upon the fact that when a capacitor is charged by a pulsed voltage having a fixed period, a voltage is developed across the capacitor with a mean value which is proportional to the period duration.

Starting from this consideration, the third embodiment of the invention disclosed hereinafter has been realized.

The primary winding 122 of the transformer 124 is fed by a high frequency square wave voltage, e.g. higher than 10 kHz.

The a.c. line voltage is rectified and filtered by a smoothing circuit 120 adapted to feed with a d.c. voltage a switch component (a MOSFET) to be described later.

In order to obtain a variable voltage value at the output of the rectifier and filter assembly 30, a switch component known as MOS insulated gate field effect transistor (MOSFET) 134 changes the ratio of the high voltage to the low voltage time periods thus allowing, in this third embodiment too, a stepwise variable feed voltage for the ion pump which is proportional to the current drawn by the ion pump and flowing along the resistor 32.

The circuits for measuring the current drawn by the ion pump, the threshold discriminator circuits and the conversion circuits are not further described in detail since they have already been illustrated with reference to the second embodiment, to which reference is made for understanding their construction and operation.

The output voltage of the conversion circuit 96, at 108, is delivered to a first input 126 of a comparator circuit 128.

A triangular waveform of fixed frequency supplied by a sawtooth oscillating circuit is applied to a second input 130 of the above comparator circuit.

Figure 6A:
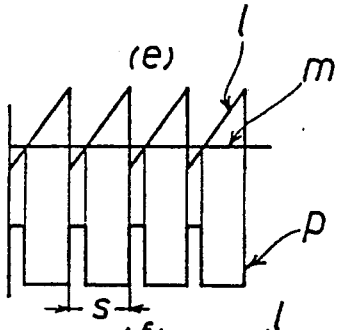
FIG. 6 shows some examples of the waveforms which are generated and controlled by the circuit shown in FIG. 5.
Figure 6B:
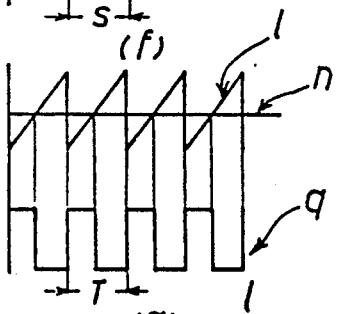
Figure 6C:
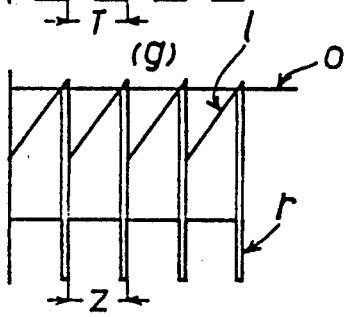

Such triangular waveform signal is marked with "1" in the diagrams "e, f and g" of FIG. 6.

When the output voltage of the conversion circuit 96 is at a low level (see line "m" in diagram "e" in FIG. 6) corresponding to a voltage $V_R$ across the resistor 32 with a value comprised between 0 and $V_1$ (e.g. from 0 to 2 V), at the output of the comparator circuit 128 there is present a rectangular waveform such as that shown in FIG. 6, marked with the letter "p" in the diagram "e", wherein in the time period shown as "S" in the diagram "e" of FIG. 6, there is a strong prevalence of the time during which the voltage is low, in respect to that in which the voltage is high.

When the output voltage from the conversion circuit 96 is at an intermediate level (see line "n" in diagram "f" of FIG. 6), corresponding to a voltage $V_R$ across the resistor 32 with a value between $V_i$ and $V_{i+1}$ (e.g. from 4 to 6 V), at the output of the comparator circuit 128 there is present a rectangular waveform such as that shown in FIG. 6, marked with the letter "q" in the diagram "f", wherein in the time period shown as "T" it can be noted that the time during which the voltage is low is equal to that in which the voltage is high.

Finally, when the output voltage from the conversion circuit 96 is at a high level (see line "o" in diagram "g" of FIG. 6), corresponding to a voltage $V_R$ across the resistor 32 with a maximum value $V_n$ (e.g. 10 V), at the output of the comparator circuit 128 there is present a rectangular waveform such as that shown with the letter "r" in the diagram "g", wherein in the time period shown as "Z" in the diagram "g" of FIG. 6, there is a strong prevalence of the time during which the voltage is high in respect to that in which the voltage is low.

On the ground of what disclosed above, the several waveforms "p", "q", "r" can be applied to the switch component (MOSFET) 134 acting as a switch as disclosed hereinafter.

When a high level voltage is applied to its control terminal 136, it acts as in a short circuit and thus a current circulates in the primary winding 122 of the transformer 124.

On the contrary, when a low level voltage is applied to the control terminal 136, the field effect transistor 134 behaves like an open circuit and the transformer 124 is not fed.

The primary winding 122 is therefore fed by a voltage with the same shape as those illustrated at "p", "q", "r" in FIG. 6.

The voltage is transferred to the secondary winding 86 of the transformer 124 and then rectified and filtered by the assembly 30.

On the ground of the above description, it will be appreciated that a d.c. low voltage (e.g. 3,000 V) will be applied to the ion pump 11 in case of prevalence of the low level, as illustrated in the "e" diagram of FIG. 6; a medium value (e.g. 5,000 V) when the low level and the high level are equal, as illustrated in the "f" diagram of FIG. 6, and a high value (e.g. 7,000 V) in case of prevalence of the high level, as illustrated in the "g" diagram of FIG. 6.

From the above description of the three embodiments of the electronic feeding device for an ion pump according to the invention, it is clear that it is possible to apply to the ion pump a plurality of different voltages in accordance with the values of the drawn current in order to optimize the pump performance, particularly at low pressures, thus achieving the advantages stated in the preamble of the description.

Of course there have been disclosed some preferred embodiments of the invention, but it is to be understood that the same can be subjected to modifications and hcanges within the scope of the same inventive idea.

We claim:

1. An improved electronic feeder for an ion pump comprising a transformer and means for rectifying and filtering the alternating current from said transformer, characterized in that said transformer is controlled by means responsive to the current drawn by the ion pump for increasing or decreasing the feed voltage of the primary winding when the current drawn by the ion pump increases or decreases respectively, said control means being connected to keep said voltage constant in a given range of current change and to vary when said current is outside said range.

2. An improved electronic feeder for an ion pump as claimed in claim 1, characterized in that the primary winding of said transformer is divided into a plurality of sections that can be actuated only separately by switch means singly activated by threshold discriminator circuits in order to feed the ion pump with a plurality of voltages that are proportional to the values of the current drawn by the ion pump.

3. An improved electronic feeder for an ion pump as claimed in claim 2, characterized in that said switch means comprises relays singly activated, each contacts of which feed a single section of the primary winding of said transformer.

4. An improved electronic feeder for an ion pump as claimed in claim 1, characterized in that it comprises means for discontinuously changing the feed voltage of the primary winding of said transformer, comprising a triac triggered by a first conversion circuit connected to a second trigger circuit of said triac.

5. An improved electronic feeder or anion pump as claimed in claim 4, characterized in that said means for discontinuously changing said feed voltage of the primary winding of said transformer comprises MOS insulated gate field effect transistor switching means actuated by a comparator circuit.

6. An improved electronic feeder for an ion pump as claimed in claim 5, characterized in that it comprises a comparator circuit adapted to compare a first d.c. voltage of variable level from a conversion circuit, with a second voltage having a triangular waveform, from a sawtooth oscillating circuit.

7. An improved electronic feeder for an ion pump as claimed in claims 5 or 6, characterized in that said comparator circuit is connected to the gate of the field effect transistor to control the feed voltage.

* * * * *